US005704519A

United States Patent [19]

Crosnier et al.

[11] Patent Number: 5,704,519

[45] Date of Patent: Jan. 6, 1998

[54] DOSAGING DEVICE WHICH CAN BE USED ON DIFFERENT CONTAINERS

[76] Inventors: Daniel Crosnier, 14, rue Jacques Lanty, 76550 Offranville; Jean-Marie Dulery, 52, Avenue, Pierre Semard, 94210 La Varenne St Maur, both of France

[21] Appl. No.: 582,607

[22] Filed: Jan. 3, 1996

[30] Foreign Application Priority Data

Jan. 4, 1995 [FR] France ..... 95 00143

[51] Int. Cl.[6] ..... B67D 5/42

[52] U.S. Cl. ..... 222/207; 222/321.7; 222/321.9

[58] Field of Search ..... 22/207, 321.1, 22/321.7, 321.9

[56] References Cited

U.S. PATENT DOCUMENTS

| | | | |
|---|---|---|---|
| 4,452,379 | 6/1984 | Bundschuh | 222/207 |
| 4,867,347 | 9/1989 | Wass et al. | 222/207 X |
| 5,152,434 | 10/1992 | Birmelin | 222/207 |
| 5,174,478 | 12/1992 | Reyman | 222/207 |
| 5,267,673 | 12/1993 | Crosnier et al. | 222/321.7 |
| 5,476,195 | 12/1995 | Oder et al. | 222/207 |
| 5,518,147 | 5/1996 | Peterson et al. | 222/207 X |
| 5,544,789 | 8/1996 | Gillingham | 222/207 X |

*Primary Examiner*—Andres Kashnikow
*Assistant Examiner*—Kenneth Bomberg
*Attorney, Agent, or Firm*—Ostrolenk, Faber, Gerb & Soffen, LLP

[57] ABSTRACT

The present invention comprises a) a push button containing a dose chamber, the chamber being defined by a peripheral wall and an upper wall and being traversed centrally by a tube which communicates with the ejection opening and is pierced radially, near its lower end, by at least one opening; b) a support which can be fitted on the container containing the material to be dispersed, on which the push button fits and on which it can slide axially; the upper part of the support is closed by a wall which comprises a central opening which permits the passage of the tube of the push button, and at least one orifice having an axis which is parallel to the opening, and made in the periphery of the support; c) a part of elastic deformable material, arranged between the push button and the support, the part comprising an extendable tubular portion which is closed at its base by a wall and which contains the tube of the push button; the lower end of the tube comes against the base wall; around the upper edge of the tubular portion, there is a collar adapted to insert itself in the upper wall of the support, for closing the peripheral orifice or orifices of the upper wall; the collar has at its upper face an annular groove bordered on the outside by a lip which is applied against the inner face of the outer wall of the push button; the collar is adapted to be deformed in order to free the peripheral orifice or orifices of the upper wall of the support.

8 Claims, 4 Drawing Sheets

DOSAGING DEVICE WHICH CAN BE USED ON DIFFERENT CONTAINERS

BACKGROUND OF THE INVENTION

The present invention relates to a dosaging device which can be used on various rigid or flexible containers, such as bottles, tubes or jars, which are used in particular in the fields of pharmacy, cosmetics and food.

At present, there are various types of dosaging devices all of which use a number of parts such as springs, balls, valves, plugs and the like. The manufacture and assembly of these parts requiring a large amount of labor. Further, these devices generally have the drawbacks of insufficient tightness as well as admitting outside air into them during their opening and closing, which makes it necessary to include preservatives in the contents in order to avoid the oxidation thereof.

In order to overcome these drawbacks, the applicants have proposed, in French patent FR-A-2.674.024, a dosaging device which comprises an inner part of elastic deformable material. When the push member of the container is depressed, the inner part is deformed and permits the ejection of one dose of the contents. Upon resuming its shape, the inner part creates a vacuum which makes it possible by suction to recreate a dose in a dose chamber. The aspirated contents pass through a valve that is formed in the deformable inner part and is connected to the inner part by a bridge of material.

However, this device has the drawback that it does not permit the dosaging of products of high viscosity. Furthermore, the elastic inner part sometimes encounters difficulties in resuming its initial shape and position, which may result in a certain inclusion of outer air.

SUMMARY OF THE INVENTION

It is an object of the present invention to overcome the above drawbacks by proposing a dosaging device which makes it possible to dose all sorts of products, even ones of high viscosity, with greater reliability, in particular with respect to tightness of closure, and which, furthermore, makes it possible to create dosages of large volume.

The device of the present invention comprises, in combination:

a) a push button containing a dose chamber, the chamber being defined by a peripheral wall and an upper wall and being traversed centrally by a tube which communicates with the ejection opening and is pierced radially, near its lower end, by at least one opening;

b) a support which can be fitted on the container containing the material to be dispersed, on which the push button fits and on which it can slide axially; the upper part of the support is closed by a wall which comprises a central opening which permits the passage of the tube of the push button, and at least one orifice having an axis which is parallel to the opening, and made in the periphery of the support;

c) a part of elastic deformable material, arranged between the push button and the support, the part comprising an extendable tubular portion which is closed at its base by a wall and which contains the tube of the push button; the lower end of the tube comes against the base wall; around the upper edge of the tubular portion, there is a collar adapted to insert itself in the upper wall of the support, for closing the peripheral orifice or orifices of the upper wall; the collar has at its upper face an annular groove bordered on the outside by a lip which is applied against the inner face of the outer wall of the push button; the collar is adapted to be deformed in order to free the peripheral orifice or orifices of the upper wall of the support.

The device of the invention operates as follows: Pressure on the push button causes the button to slide along the support. This has the effect of compressing the product contained in the dose chamber between the upper wall of the push button and the collar of the part of deformable material. The product passes between the outlet tube of the push button and the tubular portion of the deformable part, escapes through the orifice or orifices extending radially through the outlet tube and rises in that tube up to the ejection opening of the tubular portion of the deformable part. That part, which had been stretched out, resumes its initial shape upon release of the button, causing the push button to rise again and obstructing the radial orifice or orifices. This prevents the taking-in of air or the return of the product contained in the tube. It also causes the aspiration into the dose chamber of the product in the container, and the product passes through the peripheral orifice or orifices of the upper wall of the support, pushing the collar back and passing between the peripheral lip and the inner face of the wall of the push button.

These and other advantages and characteristics of the present invention will become apparent from the following description of the invention which refers to the accompanying drawings.

DETAILED DESCRIPTION OF EMBODIMENTS OF THE INVENTION

Figure 1:
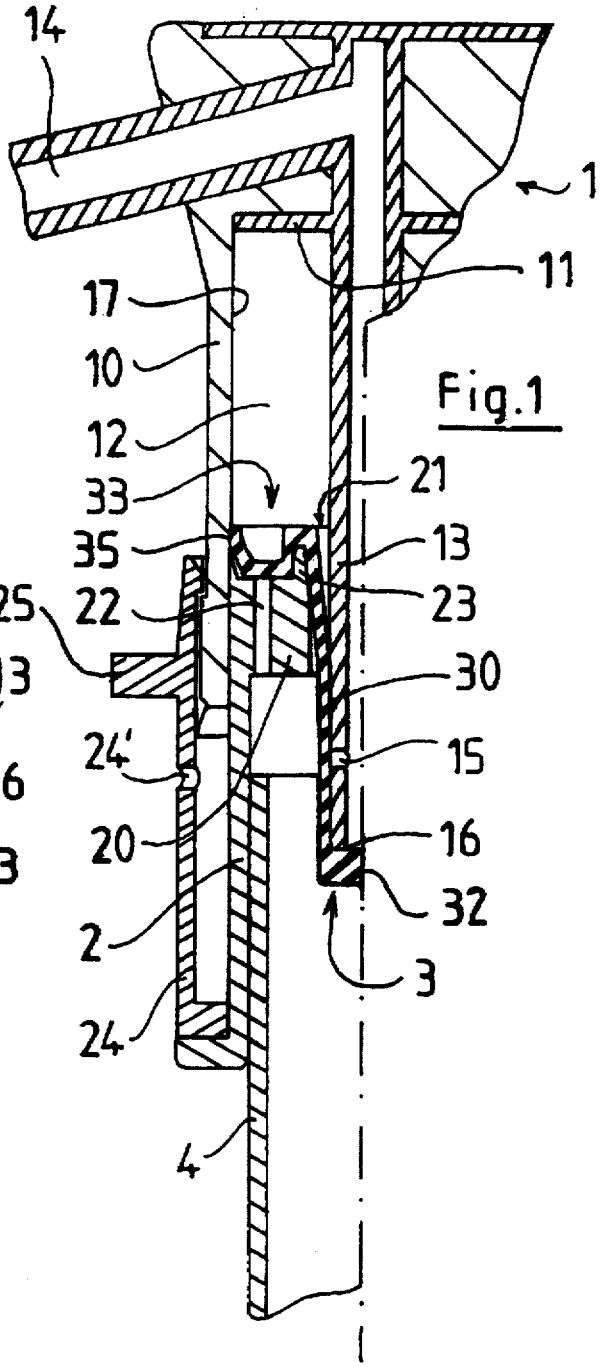
FIG. 1 is a partial view, in section, of a first embodiment of a device in accordance with the invention.

FIG. 1 shows a device according to the invention which comprises a push button 1 fitted on a support 2 on which the button can slide vertically and which is fitted on a container, not shown.

The push button 1 has a tubular outer wall 10 and has an upper wall 11. These together define a space 12 of a certain volume which constitutes a dose chamber. The push button 1 also has a central tube 13 which passes through the space 12 and communicates with an ejection opening 14 and which is pierced radially by at least one orifice 15 arranged a short distance above its lower end 16.

The support 2 comprises an upper wall 20 which is pierced by a central orifice 21 and which has peripheral orifices 22 only one of which is visible in the Figure. Those orifices are arrayed around the peripheral region of the upper wall 20 and extend parallel to the orifice 21. A plunger tube 4 is furthermore fitted on the support 2.

Figure 3:
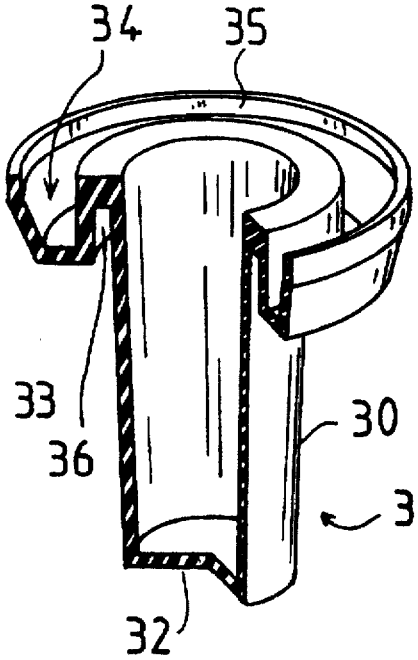
FIG. 3 is a view in perspective, partially in section, of the deformable part of a device in accordance with the invention.

The device also comprises a part 3 of elastic deformable material fitted on the support 2, between the support and the push button 1. As can be noted from FIG. 3, the deformable distendable part 3 comprises a stretchable, elastic tubular central portion 30 closed at its lower end by a wall 32. Its upper end is bordered by a collar 33 having on its upper face an annular groove 34 bordered on the outside by a peripheral lip 35.

Figure 2:
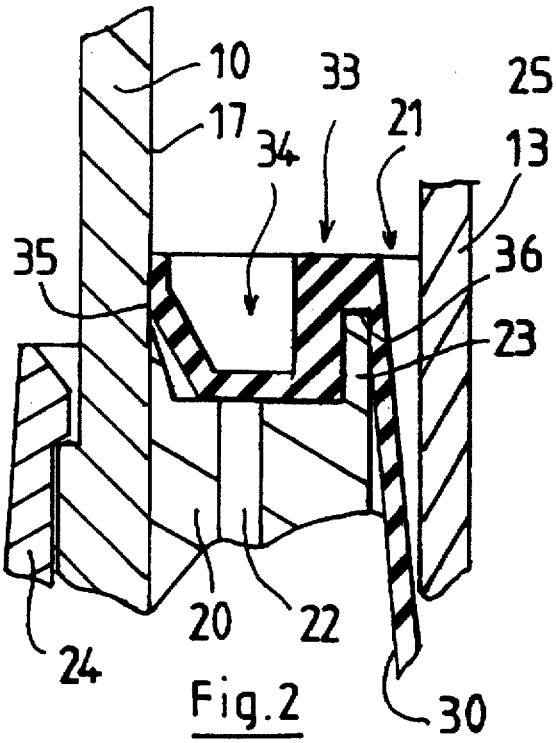
FIG. 2 is a partial sectional view, on a larger scale, of the same device.

Referring to FIG. 2, the central orifice 21 of the upper wall 20 of the support 2 is bordered by a rib 23 on which the part 3 is fitted. For this purpose, the part 3 has an annular groove 36 between the collar 33 and the tubular portion 30.

The tube 13 of the push button 1 is housed in the tubular portion 30 of the part 3, with the end 16 of the tube in contact with the wall 32, while the collar 33 of the part 3 is applied against the wall 20 of the part 2, thus closing the orifices 22. The lip 35 is applied against the inner face 17 of the tubular outer wall 10 of the push button 1.

The ejection of a dose is effected in the following manner: Pressure on the push button 1 causes the tube 13 to descend. This longitudinally deforms and distends the tubular portion 30 of the part 3 by moving the wall 32 bottom end down. The dispensable product contained in the dose chamber 12 is compressed by the button against the collar 33. This has the effect, on the one hand, of applying the collar against the upper wall 20 of the support 2, thus closing the orifices 22 and, on the other hand, of applying the peripheral lip 35 against the inner face 17 of the wall 10. This reinforces the closure preventing the removal of the dose. The dispensable product, pushed back between the tube 13 and the tubular portion 30 of the part 3, escapes down the now open path from the chamber 12 and past the interior of the tubular portion 30 and then through the radial orifice 15 of the tube 13 and rises again in the tube 13 up to the ejection opening 14.

After ejection of the dose and the release of the pressure on the push button 1, the tubular portion 30 of the part 3 resumes its initial shape and applies itself radially against the orifice 15, thus preventing air from being taken in the dose chamber from the opening 14 and preventing the return of the product, and causing the push button 1 to rise again. This creates a vacuum in the dose chamber 12 which aspirates the product contained in the plunger tube 4, which passes through the peripheral orifices 22 and fills the dose chamber 12. The collar 33 lifts under the pressure and the lip 35 comes loose from the inner face 17 of the wall 10.

The wall 10 of the push button 1 can advantageously be made of a transparent material in order to permit the user to see the dose in its entirety, which is not possible with known dosaging levels.

In FIG. 1, a ring 24 is firmly attached on the outside of the support 2 so as to be introduced into the container. A peripheral shoulder 25 limits this introduction. The wall 10 of the push button 1 slides between this ring 24 and the support 2.

The embodiment shown in FIG. 1 comprises a plunger tube 4 and is of the outer air admission type. In this case the ring 24 has an orifice 24' below the shoulder 25, which permits the entrance of the outer air into the container.

Figure 4A:
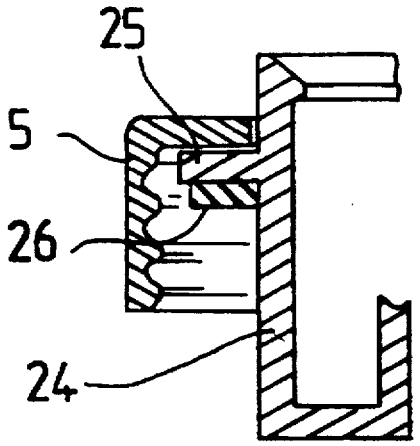
FIGS. 4*a*, 4*b*, 4*c* are partial views, in cross section, of different manners of attaching the device according to the invention onto a container.
Figure 4B:
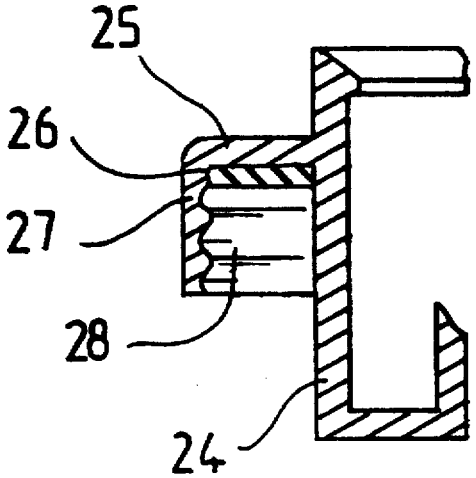
Figure 4C:
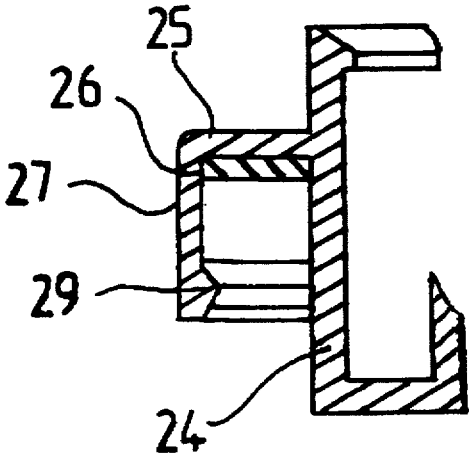

FIGS. 4*a*, 4*b*, and 4*c* show that the attachment of the device of the invention on a container (not shown) can be effected in various ways.

In FIG. 4*a*, the shoulder 25 of the ring 24 rests on the edge of the container via an annular joint 26. The fastening is effected by means of a threaded sleeve 5.

In FIG. 4*b*, the shoulder 25 is extended downward by an annular portion 27 provided with a thread 28.

In FIG. 4*c*, the annular portion 27 has a notch 29 which permits its engagement on the container.

Figure 5:
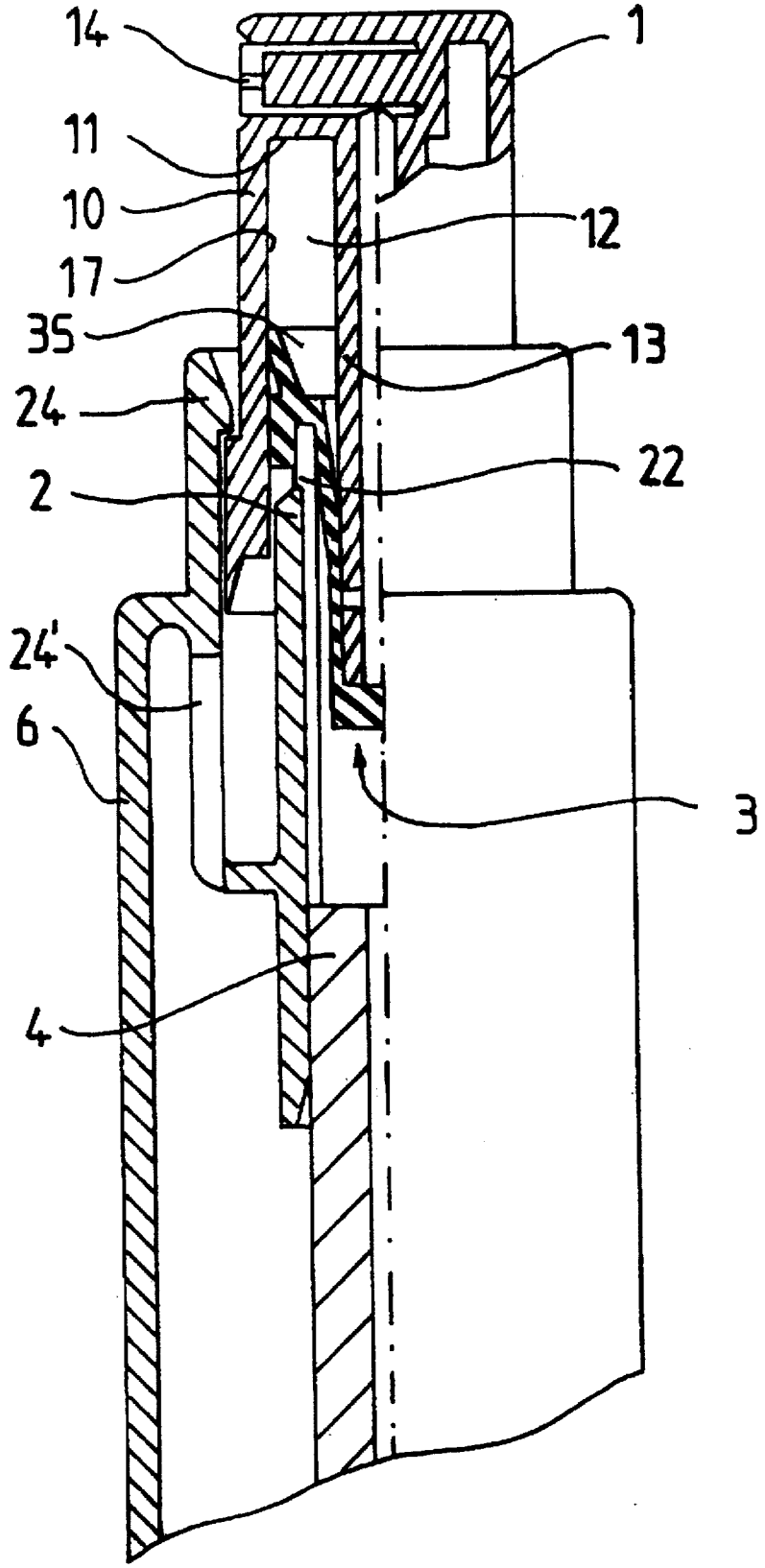
FIG. 5 is a partial sectional view of a second embodiment of the device of the invention.

FIG. 5 shows a variant of the device of the invention, which is intended, in particular for the dosaging of a liquid product, the support 2, the ring 24, and the container 6 are comprised of a single part. A slit 24' permits the taking-up of outer air.

Figure 6:
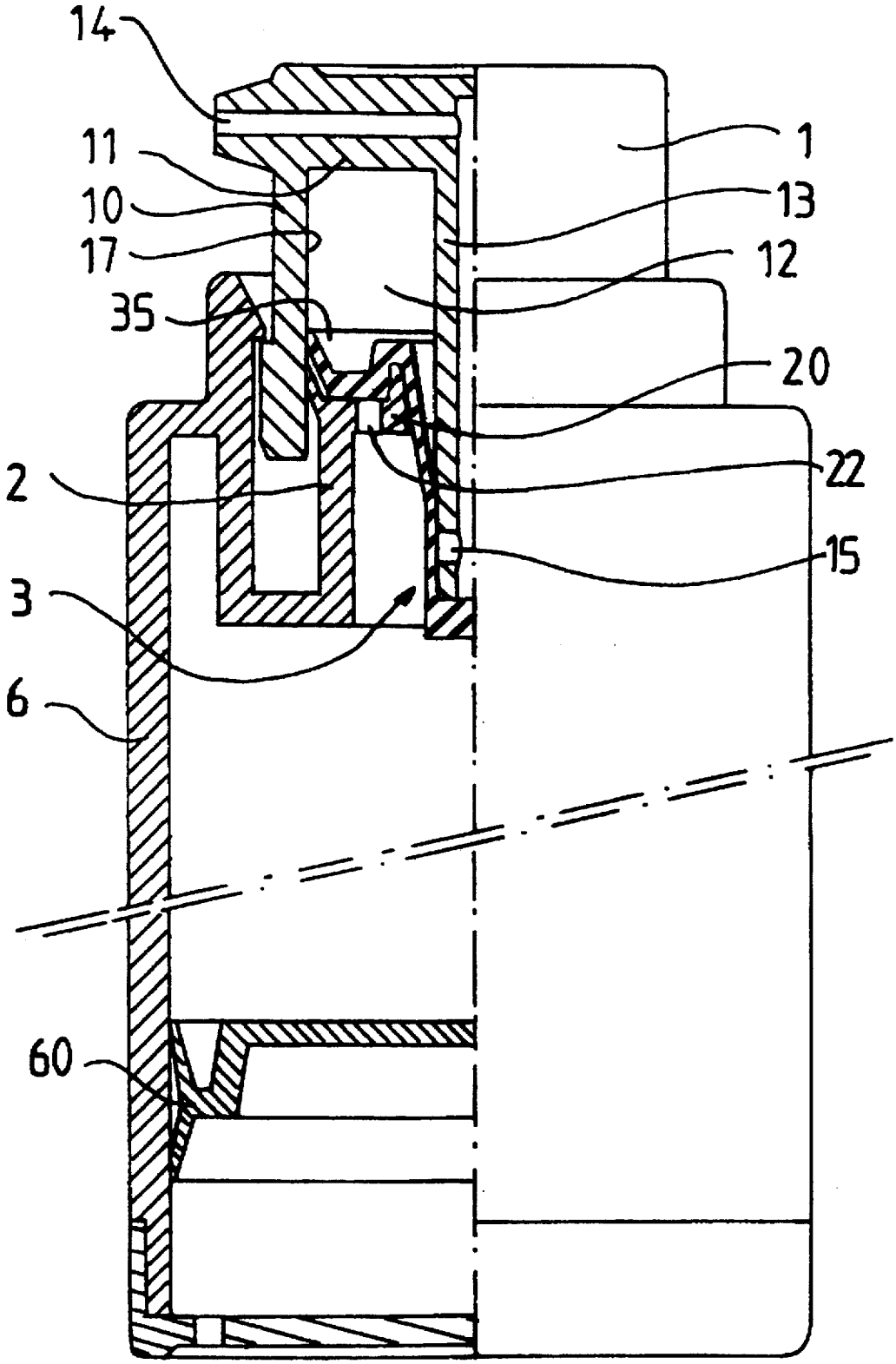
FIG. 6 is a partial sectional view of a third embodiment of the device of the invention.

FIG. 6 shows another embodiment of the device of the invention without inclusion of outer air, in which a piston 60 slides within the container 6.

The present invention is not limited to the above description of a few of its embodiments, which embodiments may be subjected to a number of changes without thereby going beyond the scope of the invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dosaging device for dosing a fluid material wherein the device can be fitted on a container, the device comprising:

a push button including: an outer wall, a central tube radially inward of the outer wall, and a dose chamber for holding the material to be dosed, the chamber being between the interior of the outer wall and the exterior of the tube; an ejection opening from the tube through which the material is injected;

the tube having a lower end, the tube having a radial opening from the exterior of the tube to the interior thereof in the vicinity of the lower end;

a support for supporting the device on a container, the push button being supported on the support and being axially slidable with respect to the support by being pushed in and rising up with respect to the support;

the support including an upper wall in the space between the interior of the outer wall and the exterior of the tube of the push button and the upper wall defining an end wall of the dose chamber, the upper wall of the support having a central opening therethrough through which the tube of the push button passes, the lower end of the tube and the radial opening in the tube being both below the upper wall of the support in all positions of the push button;

an orifice through the upper wall of the support which would communicate between the dose chamber and the container in which the device is disposed;

a deformable part of elastic deformable material to be arranged between the push button and the support for serving as a valve for selectively opening and closing the radial opening through the tube and the orifice through the upper wall of the support;

the elastically deformable part including a longitudinally extendable tubular portion including a base wall, and the lower end of the push button tube normally resting on the base wall of the part; the tubular portion being so shaped that when the tubular portion is not extended and the push button is not depressed, the tubular portion closes over the radial opening through the wall of the tube of the push button preventing passage of material through the radial opening, but when the push button is depressed and the tube presses on the base wall of the deformable portion, the deformable portion is deformed which shifts the tubular portion of the deformable part sufficiently to open the radial opening through the tube;

the tubular portion of the deformable part having an upper portion and a collar around the upper portion, the collar being shaped and positioned so that with the push button depressed and the tubular portion of the deformable part stretched, the collar rests on the upper wall of the support and blocks the orifice therethrough, and with the button undepressed and the tubular portion not stretched, the collar being deformable to open the orifice between the dose chamber and the container while the tubular portion closes the radial opening through the tube.

2. The device of claim 1, wherein there is at least one of the orifices and the orifice has an axis extending parallel to the opening in the upper wall through which the tube passes.

3. The device of claim 1, wherein the collar of the deformable part has an upper face, shaped to define an annular groove and bordered on its outside periphery by a lip that is shaped and positioned so that the lip is applied against the interior of the outer wall of the push button, such that with the collar blocking the orifice, the lip engages to seal to the outer wall of the push button.

4. The device of claim 1, wherein the support further comprises a ring attached to the outside of the support in place so that the outer wall of the push button slides between the ring of the support and the support.

5. The device of claim 4, wherein the ring is introducible into the container in which the device is disposed;

a peripheral shoulder being defined on the ring for limiting the introduction of the ring and the device into the container.

6. The device of claim 5, further comprising a threaded sleeve covering the shoulder and screwed on the container.

7. The device of claim 5, further comprising a threaded annular portion extending the shoulder downward.

8. The device of claim 5, wherein the shoulder is extended downward by an annular portion having a notch therein for permitting engagement of the notch on the container.

* * * * *